US010344779B2

(12) United States Patent
Besch et al.

(10) Patent No.: US 10,344,779 B2
(45) Date of Patent: Jul. 9, 2019

(54) HYDRAULIC RESERVOIR FOR ELECTROHYDRAULIC ACTUATOR

(71) Applicant: Parker Hannifin Corporation, Cleveland, OH (US)

(72) Inventors: Bruce Besch, Andover, MN (US); Kevin Koenigs, Prairie View, IL (US)

(73) Assignee: Parker-Hannifin Corporation, Cleveland, OH (US)

( * ) Notice: Subject to any disclaimer, the term of this patent is extended or adjusted under 35 U.S.C. 154(b) by 159 days.

(21) Appl. No.: 15/366,258

(22) Filed: Dec. 1, 2016

(65) Prior Publication Data

US 2017/0159677 A1 Jun. 8, 2017

Related U.S. Application Data

(60) Provisional application No. 62/263,253, filed on Dec. 4, 2015.

(51) Int. Cl.

| | |
|---|---|
| ***F15B 15/18*** | (2006.01) |
| ***F15B 1/26*** | (2006.01) |
| *F15B 15/28* | (2006.01) |
| *F15B 19/00* | (2006.01) |

(52) U.S. Cl.
CPC ..... *F15B 1/265* (2013.01); *F15B 15/18* (2013.01); *F15B 15/2807* (2013.01); *F15B 19/005* (2013.01); *F15B 2211/20515* (2013.01); *F15B 2211/20561* (2013.01); *F15B 2211/6336* (2013.01)

(58) Field of Classification Search
CPC .. F15B 15/18; F15B 2211/20561; F15B 1/26; F15B 1/265; F15B 2201/50; F15B 2201/515
USPC ..... 60/477
See application file for complete search history.

(56) References Cited

U.S. PATENT DOCUMENTS

| | | | | |
|---|---|---|---|---|
| 5,117,633 | A | 6/1992 | Bayer | |
| 8,146,417 | B2 * | 4/2012 | Glasson | F15B 1/08 73/168 |
| 2008/0022672 | A1 | 1/2008 | He | |
| 2010/0300279 | A1 * | 12/2010 | Kadlicko | F15B 15/18 91/361 |
| 2012/0067035 | A1 * | 3/2012 | Sweeney | F15B 15/18 60/325 |
| 2016/0061233 | A1 | 3/2016 | Staab | |

* cited by examiner

*Primary Examiner* — F Daniel Lopez
*Assistant Examiner* — Daniel S Collins
(74) *Attorney, Agent, or Firm* — Robert J. Clark

(57) ABSTRACT

An electrohydraulic actuator includes a reservoir tank having a bladder that separates hydraulic fluid from any air in the reservoir tank and includes a sensor system that detects when the hydraulic fluid is depleted from the reservoir tank.

20 Claims, 4 Drawing Sheets

NORMAL FULL RETRACT

NORMAL FULL RETRACT

NORMAL FULL RETRACT

HYDRAULIC RESERVOIR FOR ELECTROHYDRAULIC ACTUATOR

CROSS REFERENCE TO RELATED APPLICATIONS

The present application claims the benefit of the filing date of U.S. Provisional Patent Application Ser. No. 62/263,253, filed Dec. 4, 2015, the disclosure of which is incorporated herein by reference.

TECHNICAL FIELD

This invention relates to reservoir tanks for hydraulic components and has particular application to reservoir tanks that can provide make-up or differential fluid required for use in a single rod electrohydraulic actuator units where there is a need for a reservoir to provide extra fluid for the extend stroke and space for excess fluid from the retract stroke.

BACKGROUND

In current hydraulic systems, volumetric changes are common resulting from moving parts in the system and temperature changes in the hydraulic fluid. To account for these volumetric changes, current hydraulic systems include a reservoir tank to contain the overflow that occurs as a result of changes in the volume of the fluid. In any hydraulic system, it is important to prevent the ingestion of air into the system. In hydraulic reservoirs that are stationary, it is customary to ensure that the hydraulic fluid inlet is positioned at the top of the reservoir tank and exit from the bottom of the tank. Because the reservoir tank does not move, as long as the fluid outlet port is covered by hydraulic fluid, there is little risk of exposing the outlet port to the atmosphere. In non-stationary applications or in limited space applications, the reservoir tank may not always be in a position allowing gravity to ensure that the outlet port of the reservoir tank is covered by hydraulic fluid. Current approaches that address this issue involve additional structures and processes in an effort to allow the reservoir tank to tolerate movement. These approaches include pressurized systems and bladder-type systems. Pressurized systems may require specialized tools and equipment to depressurize and re-pressurize the system during repair and maintenance resulting in increased cost, duration, and complexity.

SUMMARY OF THE INVENTION

At least one benefit over the prior art is provided by an electrohydraulic actuator system comprising: An electrohydraulic actuator system comprising: an electric motor; a pump; a hydraulic fluid reservoir having a bladder positioned therein, the bladder forming a movable barrier between a hydraulic fluid on one side of the bladder and air on a second side of the bladder and the second side of the bladder fluidly connected to atmosphere outside of the hydraulic fluid reservoir.

At least one benefit over the prior art is provided by an electrohydraulic actuator system comprising: an electric motor; a reversible hydraulic pump attached to and driven by the electric motor; a double-acting, single-rod hydraulic actuator fluidly connected to the hydraulic pump; a hydraulic fluid reservoir attached to the hydraulic pump and fluidly connected to the hydraulic pump, the hydraulic fluid reservoir providing a storage volume for hydraulic fluid that is pumped into and out of the hydraulic fluid reservoir; the hydraulic fluid reservoir including a reservoir container including a bladder positioned therein, the bladder forming a movable barrier between hydraulic fluid on a first side of the bladder and air on a second side of the bladder; the reservoir container having a vent fluidly connecting the second side of the bladder to atmosphere outside of the hydraulic fluid reservoir, wherein the bladder expands with the intake of air when hydraulic fluid is pumped from the reservoir container and wherein the bladder contracts by allowing the air to leave the reservoir container when hydraulic fluid is pumped into the reservoir container.

At least one benefit over the prior art is provided by an electrohydraulic actuator system comprising: an electric motor; a hydraulic pump attached to and driven by the electric motor; a hydraulic actuator fluidly connected to the hydraulic pump; a hydraulic fluid reservoir attached to the hydraulic pump and fluidly connected to the hydraulic pump, the hydraulic fluid reservoir providing a storage volume for hydraulic fluid that is pumped into and out of the hydraulic fluid reservoir; the hydraulic fluid reservoir including a reservoir container including a bladder positioned therein, the bladder forming a movable barrier between hydraulic fluid contacting an exterior of the bladder and air within the interior of the bladder, the bladder expanding to substantially the entire volume of hydraulic fluid exiting the reservoir container and contracting by substantially the entire volume of fluid entering the reservoir container; and a sensor system including an electroactive polymer material bonded to the bladder that provides a signal at least when the bladder has expanded to a predetermined amount.

BRIEF DESCRIPTION OF THE DRAWINGS

An embodiment of this invention will now be described in further detail with reference to the accompanying drawings, in which.

DESCRIPTION OF DRAWINGS

Figure 1:
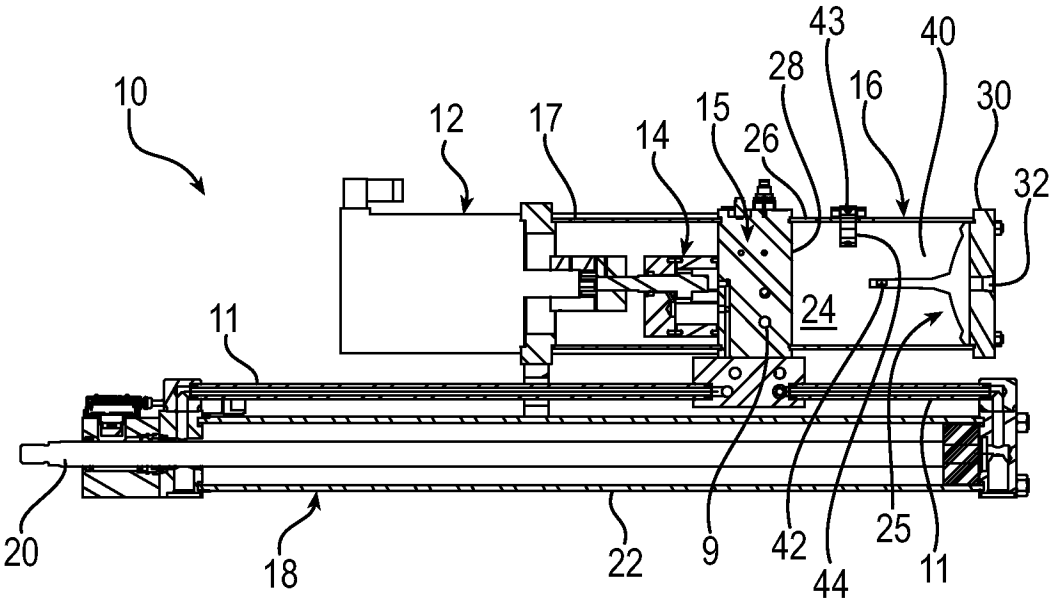
FIG. 1 is a longitudinal section view of an electrohydraulic actuator system showing the reservoir in an operational condition full of hydraulic fluid.
Figure 2:
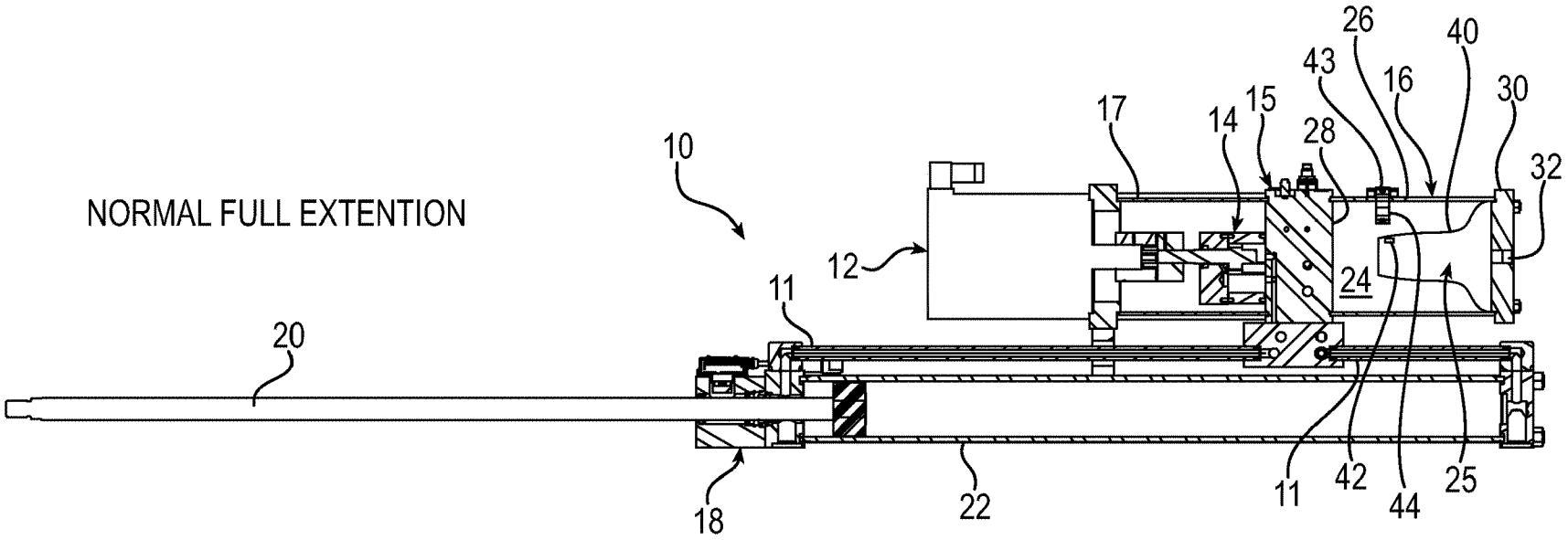
FIG. 2 is a longitudinal section view of the electrohydraulic actuator system of FIG. 1 showing the actuator at full extension and showing the reservoir in an intermediate operational condition showing expansion of the bladder at normal depletion.
Figure 3:
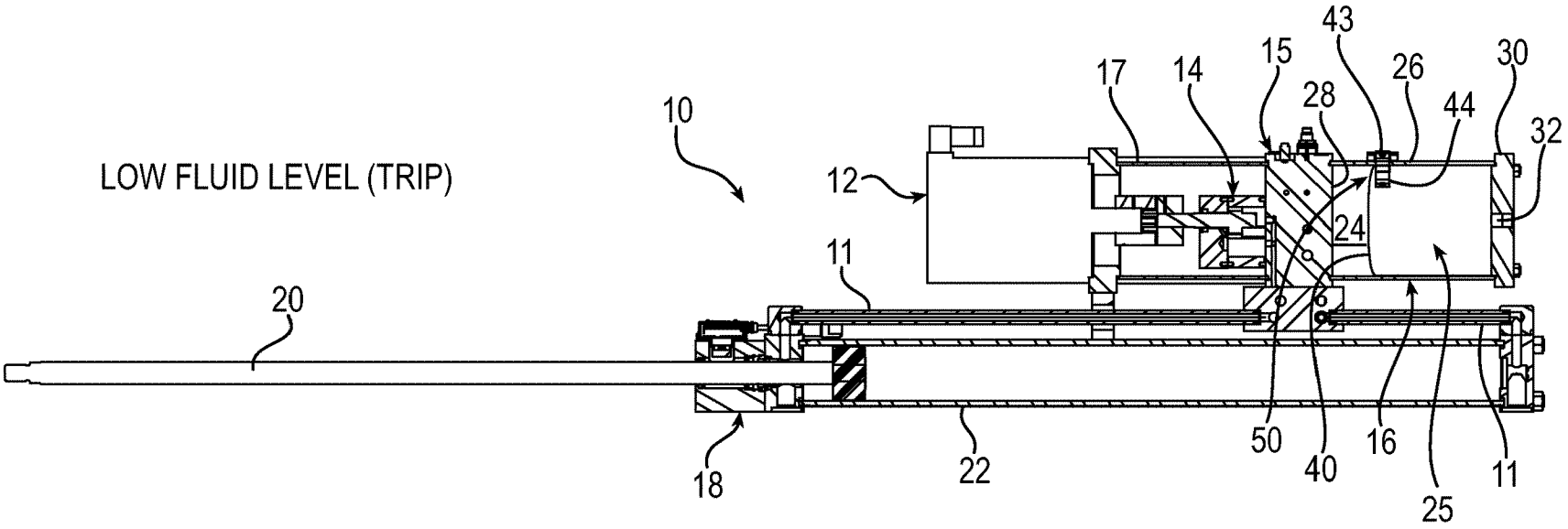
FIG. 3 is a longitudinal section view of the electrohydraulic actuator system of FIG. 1 showing the actuator at full extension and showing expansion of the bladder at full depletion (low fluid level).

Referring to the FIGS. 1-3, the electrohydraulic actuator system 10 comprises an electric motor 12, a hydraulic pump 14, and a hydraulic fluid reservoir assembly 16. The pump 14 is fluidly connected to a hydraulic actuator 18 having an actuator rod 20 retractibly/extendable from cylinder 22. The electric motor 12 may be a brushed and brushless permanent magnet motor, a stepper motor, or other motor known in the art as appropriate for use in electrohydraulic actuators. The pump 14 is typically a reversible hydraulic pump or other pump known in the art for electrohydraulic actuators. The pump 14 is reversibly driven by the electric motor 12 to pump hydraulic fluid to the hydraulic actuator 18 as is known in the art. The pump 14 is shown within a cylindrical cover 17 and attached to a manifold 15 that houses fluid passageways 9 and is connected to tubing 11 for fluidly connecting the pump 14 to the hydraulic actuator 18. The hydraulic actuator 18 is shown as a double-acting, single-rod hydraulic actuator, but is not limited to such a configuration.

The hydraulic fluid reservoir assembly 16 includes a reservoir chamber 25 enclosed by a reservoir shell 26, a first end 28 fluidly connected to the pump 14 and a second end 30. The second end 30, has a vent 32 connecting the interior of the bladder 40 to atmosphere. The reservoir shell 26 may be made of a transparent material. A bladder 40 is shown in the reservoir chamber 25 which is fluidly connected by vent 30 to the atmosphere outside the reservoir chamber 25. The bladder 40 may be made of an appropriate elastomeric material. Hydraulic fluid 24 is shown on the unvented side or exterior of the bladder 40 in the reservoir chamber 25. The reservoir chamber 25 includes the volume occupied by the hydraulic fluid 24 and the bladder 40. In FIG. 1, the reservoir chamber 25 is shown is a full hydraulic fluid condition with the bladder 40 in a substantially fully contracted condition which corresponds to a fully retracted position of the rod 20 of the hydraulic actuator 18.

In FIG. 2, as the hydraulic actuator rod 20 is fully extended, the hydraulic fluid 24 flows out of the hydraulic reservoir chamber 25 and the bladder 40 expands to substantially the entire volume of hydraulic fluid exiting the reservoir chamber 25. Atmosphere from outside the electrohydraulic actuator system 10 is pulled through the vent 32 and into bladder 40.

The electrohydraulic actuator system 10 may further include a sensor system 50 which provides a signal when the bladder 40 has expanded to a predetermined amount. The sensor system 50 is shown as a magnet 42 which is bonded to the bladder 40 and as a low level window 43 tripped with a proximity switch 44. FIG. 2 represents normal depletion of hydraulic fluid from the reservoir chamber 25. In FIG. 3, the electrohydraulic actuator system 10 is shown with the hydraulic fluid in a depleted condition. The magnet 42 is shown in the low level window 43 tripped with proximity switch 44. This FIG. 3 represents the maximum depletion of hydraulic fluid 24 from the reservoir chamber 25. This depletion could be set at 90%, 80%, 70% or any predetermined amount of the volume of the reservoir chamber 25.

In the reverse operation, and returning sequentially from FIG. 3 to FIG. 1, as the piston rod 20 retracts, the hydraulic fluid 24 enters the reservoir chamber 25 and the bladder 40 contracts by substantially the entire volume of fluid entering the reservoir chamber 25. Atmosphere from bladder 40 is expelled through the vent 32 and to the atmosphere. During operation of the electrohydraulic actuator system 10, substantially no air is in direct contact with the hydraulic fluid 24 and the air within the bladder 40 does not contact the hydraulic fluid 24.

Figure 4:
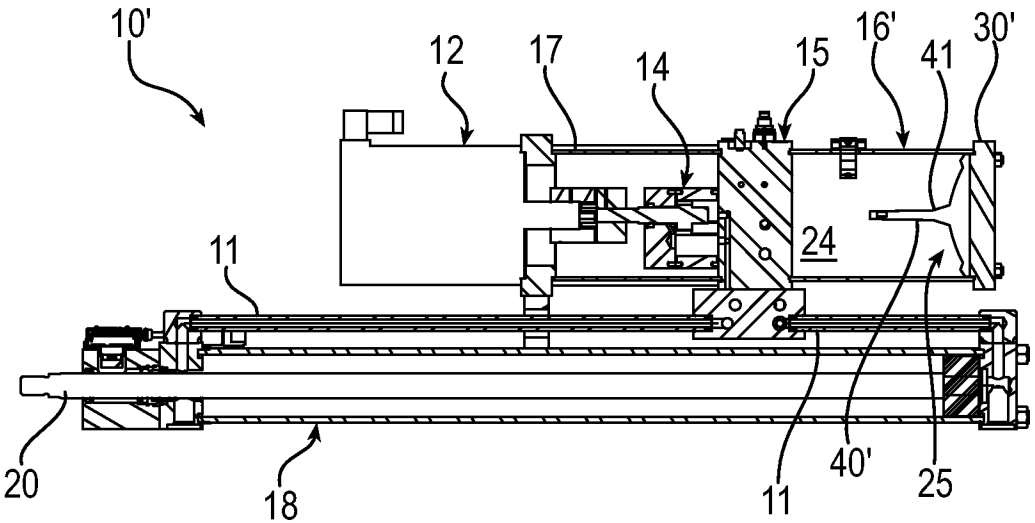
FIG. 4 is a longitudinal section view of another embodiment of an electrohydraulic actuator system showing a sealed reservoir in an operational condition full of hydraulic fluid.

The shape and construction of the bladder 40 may be tubular in shape and of variable lengths depending upon the application. The bladder 40 is constructed to allow for a) bonding of a magnet for position measurement, b) visibility of fluid fill when used with clear reservoir shell 26, c) the open end can be cut to length for the particular capacity required and is suitable for variable sizing/volume, d) sealing/isolation is accommodated by several factors, including the bladder 40 itself as a barrier, capture of the bladder 40 by wrapping over the end of the bladder 40 and past the endcap seal, and the fact that the bladder 40 itself, when pulled in a vacuum, provides additional sealing as the outer surface of the bladder 40 is expanded against the reservoir shell 26. In addition, the general construction, with inherent isolation, allows for either venting to atmosphere with no risk of contamination by using a vent 32, or low pressure pre-load <200 PSI by using a sealed configuration without a vent 32. The unvented configuration is shown in FIG. 4 depicting electrohydraulic actuator system 10' having hydraulic fluid reservoir assembly 16' including second end 30' which does not have a vent. Sealing the reservoir assembly 16' could result in operational issues due to potential vacuum created when hydraulic fluid 24 is removed from the reservoir chamber 25, although this may not be a problem in smaller volume units. The use of a sealed reservoir chamber 25 provides the opportunity to induce slight pressure as a means to ensure that hydraulic fluid 24 is forced into the operating portion of the electrohydraulic actuator system 10', so the ability of the reservoir chamber 25 to be pressurized, because it is sealed, provides a benefit to function. Optionally, a sensor 41 made of an electroactive polymer material can be bonded to the bladder 40', or formed as at least a portion of the bladder 40'. The sensor 41 provides an electric signal to the sensor system 50' when the bladder 40' expands or contracts.

This present invention has particular application in providing a sealed and/or separated unit that can provide make-up or differential fluid required for use in a single rod electrohydraulic actuator unit. Since the single-rod electrohydraulic actuator will have differential areas on opposite sides of the piston, there is need for a reservoir to provide extra fluid for the extend stroke and space for excess fluid from the retract stroke. In addition, there is benefit to the tank being able to be isolated from external contamination (dirt, moisture, aeration, etc.) so that the operating fluid remains clean. A further feature of the current invention is the use of a barrier between the operating fluid and the alternate space that may be sealed or vented, pressurized or subject to vacuum. The use of this barrier provides the flexibility to incorporate operational features and characteristics that result in a variety of opportunities for usage, as described herein.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

What is claimed is:

1. An electrohydraulic actuator system comprising:

an electric motor;

a pump;

a hydraulic fluid reservoir having a bladder positioned therein, the bladder forming a movable barrier between a hydraulic fluid on a first side of the bladder and air on a second side of the bladder and the second side of the bladder fluidly connected to atmosphere outside of the hydraulic fluid reservoir; and a sensor system that signals when the bladder has expanded to a predetermined amount, the sensor system including a magnet bonded to the bladder.

2. The electrohydraulic actuator system as in claim 1, wherein the predetermined amount is at least 90% of the volume of the reservoir container.

3. The electrohydraulic actuator system as in claim 1, wherein the predetermined amount is at least 80% of the volume of the reservoir container.

4. The electrohydraulic actuator system as in claim 1, wherein the predetermined amount is at least 70% of the volume of the reservoir container.

5. The electrohydraulic actuator system as in claim 1, further comprising a single rod actuator fluidly attached to the hydraulic fluid reservoir.

6. The electrohydraulic actuator system as in claim 1, the hydraulic fluid reservoir including an end cap having an aperture therethrough which fluidly connects the second side of the bladder within the hydraulic fluid reservoir to the atmosphere outside the hydraulic fluid reservoir.

7. The electrohydraulic actuator system as in claim 1, the hydraulic fluid reservoir including a transparent reservoir shell.

8. The electrohydraulic actuator system as in claim 1, the bladder being formed at least in part by an electroactive polymer material.

9. The electrohydraulic actuator system as in claim 1, the signal provided by the sensor system is connected to the Internet.

10. The electrohydraulic actuator system as in claim 1, wherein the bladder expands with the intake of air when hydraulic fluid is pumped from the reservoir container and wherein the bladder contracts by allowing the air to leave the reservoir container when hydraulic fluid is pumped into the reservoir container.

11. An electrohydraulic actuator system comprising:

an electric motor;

a hydraulic pump attached to and driven by the electric motor;

a hydraulic actuator fluidly connected to the hydraulic pump;

a hydraulic fluid reservoir attached to the hydraulic pump and fluidly connected to the hydraulic pump, the hydraulic fluid reservoir providing a storage volume for hydraulic fluid that is pumped into and out of the hydraulic fluid reservoir;

the hydraulic fluid reservoir including a reservoir container including a bladder positioned therein, the bladder forming a movable barrier between hydraulic fluid contacting an exterior of the bladder and air within the interior of the bladder, the bladder expanding to substantially the entire volume of hydraulic fluid exiting the reservoir container and contracting by substantially the entire volume of fluid entering the reservoir container; and a sensor system including an electroactive polymer material bonded to the bladder that provides a signal at least when the bladder has expanded to a predetermined amount.

12. The electrohydraulic actuator system as in claim 11, wherein the sensor system provides a continuous status of the magnitude of the expansion/contraction of the bladder.

13. The electrohydraulic actuator system as in claim 11, wherein the interior of the bladder is fluidly connected to atmosphere outside the electrohydraulic actuator system by a vent formed through the hydraulic reservoir container.

14. An electrohydraulic actuator system comprising:

an electric motor;

a pump;

a hydraulic fluid reservoir having a bladder positioned therein, the bladder forming a movable barrier between a hydraulic fluid on one side of the bladder and air on a second side of the bladder and the second side of the bladder fluidly connected to atmosphere outside of the hydraulic fluid reservoir; and a sensor system that signals when the bladder has expanded to a predetermined amount, the sensor system including a proximity switch mounted in the reservoir container.

15. The electrohydraulic actuator system as in claim 14, wherein the predetermined amount is at least 70% of the volume of the reservoir container.

16. The electrohydraulic actuator system as in claim 14, further comprising a single rod actuator fluidly attached to the hydraulic fluid reservoir.

17. The electrohydraulic actuator system as in claim 14, the hydraulic fluid reservoir including an end cap having an aperture therethrough which fluidly connects the second side of the bladder within the hydraulic fluid reservoir to the atmosphere outside the hydraulic fluid reservoir.

18. The electrohydraulic actuator system as in claim 14, the hydraulic fluid reservoir including a transparent reservoir shell.

19. The electrohydraulic actuator system as in claim 14, the bladder being formed at least in part by an electroactive polymer material.

20. The electrohydraulic actuator system as in claim 14, the signal provided by the sensor system is connected to the Internet.

* * * * *